US005800731A

United States Patent [19]

Pirck et al.

[11] Patent Number: 5,800,731

[45] Date of Patent: Sep. 1, 1998

[54] HOMOGENEOUS ELECTROVISCOUS FLUIDS USING ALUMINUM COMPOUNDS

[75] Inventors: Dietrich Pirck, Seevetal; Hans-Dieter Grasshoff, Hamburg; Harald Kohnz, Oberhausen; Peter Finmans, Duisburg; Tobias Carstensen, Wüfrath; Dieter Jakubik, Mülheim a.d. Ruhr; Wilfried Weber, Brühl-Schwadorf; Dieter Winkler, Mülheim bei Blankenheim, all of Germany

[73] Assignee: RWE-DEA Aktiengesellschaft fur Mineraloel und Chemie, Germany

[21] Appl. No.: 664,294

[22] Filed: Jun. 11, 1996

Related U.S. Application Data

[63] Continuation-in-part of Ser. No. 244,474, filed as PCT/EP92/01004, Nov. 30, 1992, abandoned, and Ser. No. 374,731, filed as PCT/DE94/00595, May 25, 1994, abandoned.

[30] Foreign Application Priority Data

Nov. 28, 1991 [DE] Germany ..... 4139065.2
May 28, 1993 [DE] Germany ..... 4317764.6

[51] Int. Cl.[6] ..... C10M 129/28; C10M 129/64; C10M 171/00

[52] U.S. Cl. ..... 252/76; 252/73; 252/579; 508/506; 508/539

[58] Field of Search ..... 252/73, 76, 572, 252/578, 579; 508/452, 506, 539, 523; 556/183

[56] References Cited

U.S. PATENT DOCUMENTS

| | | | |
|---|---|---|---|
| 2,396,744 | 3/1946 | Morway | 508/539 |
| 2,528,373 | 10/1950 | Knowles et al. | 508/506 |
| 2,699,428 | 1/1955 | Lux et al. | 508/506 |
| 2,851,417 | 9/1958 | Andress, Jr. | 508/387 |
| 2,932,659 | 4/1960 | Orthner et al. | 556/183 |
| 3,017,361 | 1/1962 | Morris et al. | 508/539 |
| 3,047,507 | 7/1962 | Winslow | 252/75 |
| 3,271,310 | 9/1966 | LeSuer | 508/506 |
| 3,413,222 | 11/1968 | Hotten | 508/506 |
| 3,632,509 | 1/1972 | Inami et al. | 508/506 |
| 3,684,566 | 8/1972 | Josten et al. | 556/183 |
| 3,791,972 | 2/1974 | Myers | 508/525 |
| 3,939,082 | 2/1976 | Williams et al. | 508/539 |
| 4,225,447 | 9/1980 | Law et al. | 252/76 |
| 4,714,567 | 12/1987 | Roha | 252/315.2 |
| 4,886,610 | 12/1989 | Wirth et al. | 508/362 |
| 5,125,555 | 6/1992 | Grisoni et al. | 228/9 |
| 5,266,229 | 11/1993 | Tomizawa et al. | 252/73 |

FOREIGN PATENT DOCUMENTS

| | | |
|---|---|---|
| 3536934 | 4/1987 | Germany . |
| 93/11209 | 6/1993 | WIPO . |

*Primary Examiner*—Christine Skane
*Attorney, Agent, or Firm*—Madan & Morris

[57] ABSTRACT

Homogeneous, electro-viscous fluids are provided which contain aluminum soaps based on products obtained by reacting one or more mono- or polycarboxylic acid(s) or the anhydrides or semi-esters thereof with reactive aluminum compounds, such as aluminum alcoholates. The aforesaid fluids manifest high electro-rheological effect and are completely homogeneous, and do not require a dispersant.

14 Claims, 4 Drawing Sheets

ER - Adjustable Hydraulic Shock Absorber - Damping Characteristic

HOMOGENEOUS ELECTROVISCOUS FLUIDS USING ALUMINUM COMPOUNDS

This is a continuation-in-part application of application Ser. No. 08/244,474 filed on May 27, 1994 (now abandoned), based on International Application PCT/EP92/01004 filed on 30 Nov., 1992 and which designated the U.S., and a continuation-in-part application of application Ser. No. 08/374,731 filed on Jan. 27, 1995 (now abandoned), based on International Application PCT/DE94/00595 filed on 25 May, 1994 and which designated the U.S.

FIELD OF THE INVENTION

The invention relates to homogeneous electro-viscous fluids (EVF), and more particularly relates to EVFs made using aluminum compounds.

BACKGROUND OF THE INVENTION

Electro-viscous fluids are known for some time in the form of finely divided hydrophilic solids dispersed in hydrophobic fluids. The special features of such fluids are that their flow characteristics and, thus, their viscosities can be changed within a large range by subjection to an electrical field, thereby providing a great variety of applications. Electro-viscous fluids are particularly intended for use in the field of industrial and vehicle hydraulics, e.g. for machine and engine bearings or dampers, for positioning workpieces, for levelling out, cushioning and damping vehicles, for hydrodynamic power transmission and automatic clutches.

The compositions of known electro-viscous fluids for said applications may be rather different. Usually, electro-viscous fluids comprise three components: (1) a dispersed phase containing silicates, zeolites, titanates, semiconductors, polysaccharides or organic polymers; (2) an electrical, non-conducting hydrophobic fluid as liquid phase; and (3) a dispersant. In DE 35 36 934 A1 electro-viscous fluids have been described, the disperse phase of which comprises aluminum silicates having a water content of from 1 to 25 wt. % and an Al/Si atomic ratio on its surface of between 0.15 and 0.80.

However, since all heretofore known electro-viscous fluids are emulsions, they have the disadvantage of requiring a considerable amount of additional dispersive components to reduce the material-related tendency to sedimentation. Therefore, for use in modern hydraulic aggregates, most of the known products have proved to be unsatisfactory, especially when used over long periods. In particular, conventional dispersions manifest techno-hydraulic disadvantages, some of which are listed in the following:

- tendency to very high abrasion,
- evaporation of water of crystallization,
- nonfilterability (no separation of foreign matter),
- presence of components which have toxicological and safety concerns,
- incompatibilities with elastomeric sealants.

Furthermore, it is known that a great number of high-polar fluids, too, change their flow characteristics in a high-voltage field. But since these effects are only weakly observed, no technical use can be made thereof.

SUMMARY OF THE INVENTION

Accordingly, it is an object of the present invention to provide a homogeneous electro-viscous fluids which comply with the technical requirements made on a modern industrial hydraulic fluid and which do not have the foregoing disadvantages, but rather manifest a high electro-viscous effect.

In carrying out these and other objects of the invention, there is provided, in one form, a method of using a homogeneous electro-viscous fluid as a hydraulic fluid where first the homogeneous electro-viscous fluid is inserted into a machine. The homogeneous electro-viscous fluid includes aluminum soaps which are made by reacting (i) at least one saturated or unsaturated monomeric, oligomeric or polymeric $C_3$ to $C_{32}$ carboxylic acid having at least two carboxylic groups, and/or an anhydride thereof or a semi-ester thereof, where the semi-ester has an alcohol moiety from straight or branched, mono-hydric or polyhydric $C_1$ to $C_{12}$ alcohols or oligomers thereof with (ii) at least one aluminum compound reactive with carboxylic acid groups to form—C(=O)O—Al groups. The reactive aluminum compound may be selected from the group consisting of:

a. aluminum alcoholate comprising an alcohol moiety thereof comprising one or more aliphatic straight or branched, mono- or polyhydric $C_1$ to $C_{18}$ alcohols;
b. aluminum oxoalcoholate comprising an alcohol moiety thereof comprising one or more aliphatic straight or branched, $C_1$ to $C_6$ alcohols;
c. aluminum alkyls where the alkyl moieties are linear or branched $C_1$ to $C_6$ alkyl;
d. aluminum oxo alkyls where the alkyl moieties are linear or branched $C_1$ to $C_6$ alkyl;
e. aluminum hydroxycarboxylates where the carboxylic acid moieties are obtained from linear or branched aliphatic or unsaturated $C_2$ or $C_{30}$ carboxylic acids;
f. aluminum oxocarboxylates where the carboxylic acid moieties are obtained from linear or branched aliphatic or unsaturated $C_2$ or $C_{30}$ carboxylic acids;
g. aluminum alkoxycarboxylates where the alcohol moieties of the aluminum alkoxycarboxylates are linear or branched $C_1$ to $C_6$ alcohols and where the carboxylic acid moieties of the aluminum alkoxycarboxylates are linear or branched aliphatic or unsaturated $C_2$ to $C_{30}$ carboxylic acids;
h. aluminum oxides and aluminum oxide hydrates of the general formula $Al_2O_3.nH_2O$, where n ranges from 0 to 6;
i. aluminum metal;
j. aluminum hydride;
k. aluminum-tris-acetylacetone;
l. aluminum monocarboxylate.

In this application, the term "oxo" always means oxygen double bonded to aluminum; while "oxy" refers to compounds with an —O— group, such as methoxy (Me—O—), e.g.

Pressure is then applied to the homogeneous electro-viscous fluid, and the homogeneous electro-viscous fluid is used to transfer the pressure through the machine.

In another embodiment of the present invention, the above-noted problems are addressed by homogeneous electro-viscous fluids comprising aluminum soaps which are prepared by reacting one or more saturated and/or unsaturated monomeric, oligomeric and/or polymeric $C_3$ to $C_{32}$ polycarboxylic acid(s) having at least two carboxylic group (s), the anhydrides and/or semi-esters thereof, the alcohol component(s) of the semi-ester(s) is (are) linear or branched monohydric or polyhydric $C_1$ to $C_{12}$ alcohols and/or the oligomers thereof, with one or more of the following reactive aluminum compound(s):

aluminum alcoholates, aluminum alkyls, aluminum oxo alkyls, aluminum hydroxycarboxylates, aluminum oxocarboxylates, aluminum oxoalcoholates, aluminum alkoxycarboxylates, aluminum oxides and/or aluminum oxyhydrates.

In an important embodiment of the invention, electro-viscous fluids are provided which are homogeneous, yet have an absence of a dispersant. Nevertheless, such fluids have a given viscosity which can be adjusted by a surrounding electrical field to great effect.

DETAILED DESCRIPTION OF THE INVENTION

Aluminum Soaps

Carboxylic Acid and Derivatives

Figure 1:
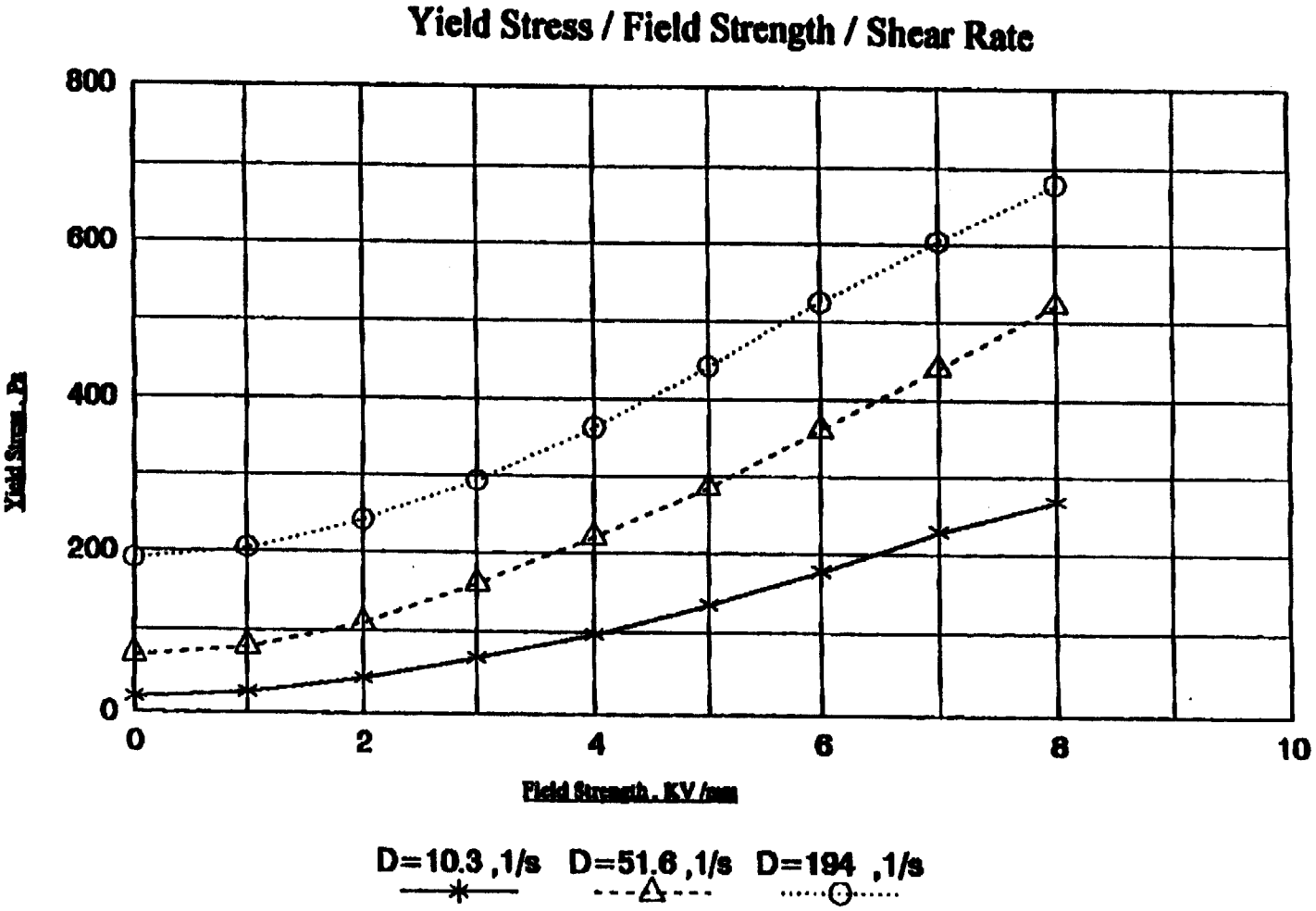
FIG. 1 is a chart of the yield stress as a function of field strength for a homogeneous electro-viscous fluid of this invention at various shear rates.

In one embodiment of the invention, the saturated or unsaturated monomeric, oligomeric or polymeric carboxylic acids having at least two carboxylic groups, and/or an anhydride thereof or a semi-ester thereof have from 3 to 32 carbon atoms, preferably 3 to 18 carbon atoms, and particularly 12 to 18 carbon atoms. A carboxylic group is defined herein as the group

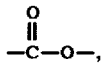

also represented linearly herein as: —C(=O)O—. If the carboxylic acid reactant to make the aluminum soap is a semi-ester of the enumerated carboxylic acids, noted immediately above, the alcohol component(s) thereof may be straight or branched monohydric or polyhydric alcohols with from 1 to 12 carbon atoms, preferably 1 to 6 carbon atoms, and particularly 2 to 5 carbon atoms, and/or the oligomers thereof.

Reactive Aluminum Compounds

With respect to the aluminum alcoholate reactant, if used, the alcohol moiety thereof may be one or more aliphatic straight or branched, mono- or polyhydric alcohols with 1 to 18 carbon atoms, preferably 2 to 8 carbon atoms, particularly 2 to 5 carbon atoms. The reactive aluminum compounds may also be aluminum alkyls and aluminum oxo alkyls having linear or branched $C_1$ to $C_6$ alkyl moieties; aluminum hydroxycarboxylates and aluminum oxocarboxylates having linear or branched aliphatic or unsaturated $C_2$ or $C_{30}$ carboxylic acids; aluminum oxoalcoholates having aliphatic straight or branched, $C_1$ to $C_6$ alcohols; aluminum alkoxycarboxylates having linear or branched $C_1$ to $C_6$ alcohols and linear or branched aliphatic or unsaturated $C_2$ to $C_{30}$ carboxylic acids; and aluminum oxides and aluminum oxide hydrates of the general formula $Al_2O_3.nH_2O$, where n ranges from 0 to 6.

It was surprisingly found that by doping with aluminum a great electrorheological (ER) effect is attained. It has been further found that reacting aluminum compounds with a carboxylic acid (or derivative thereof) with one carboxylic acid group gives a soap which will at least modify an existing ER effect. It has also been discovered that complex aluminum soaps created by reacting aluminum compounds with a carboxylic acid (or derivative thereof) having at least two carboxylic acid groups are particularly responsible for ER effects in the fluid. In other words, the complex aluminum soaps have at least one aluminum atom which is bonded to at least two carboxylic groups, to give a unit such as:

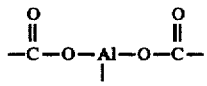

These complex aluminum soaps may be understood as roughly corresponding to polymeric materials. If the aluminum atom is bonded to three carboxylic groups, to give a unit such as:

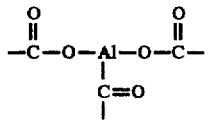

then the complex aluminum soaps may be understood as roughly corresponding to polymeric materials which are cross-linked. Such materials are expected to occur in the instant aluminum soaps and to have a beneficial effect. Furthermore, the resultant products are completely homogeneous.

The aluminum soaps used according to this invention are the products obtained by the reaction of polycarboxylic acids, anhydrides or semi-esters with the active aluminum compounds, all or part of the valences of the aluminum having been reacted. In one embodiment of the invention, those aluminum soaps are used which have been obtained by reacting polycarboxylic acids, the anhydrides and, particularly, the semi-esters thereof which have one or more free hydroxyl (OH) group(s) with aluminum alcoholates. In particular, the aluminum soaps are produced by using one or more alkenyl succinic acid(s) and/or the semi-esters thereof having 5 to 18 carbon atoms, preferably 12 to 18 carbon atoms.

Electro-Viscous Fluids

It is preferred that the electro-viscous fluids according to the invention comprise the following components:

component (a): 0.5 to 50 wt. %, preferably 1 to 20 wt. %, particularly 1 to 8 wt. % of the aluminum soap, in homogeneous solution with component (b) 50 to 98 wt. %, preferably 60 to 95 wt. %, particularly 65 to 90 wt. % of a conventional hydraulic base fluid, and additionally component (c) 0 to 10 wt. %, preferably 0 to 5 wt. %, particularly 0.1 to 2 wt. % of soluble hydraulic additives known as such, each referring to the total composition.

Component (a) consists of oligomeric complex aluminum soaps based on reaction adducts of polycarboxylic acids or olefin carboxylic acids, the anhydrides, semi-esters or oligomers thereof with the active aluminum compounds. Saponification takes place, wholly or in part, for example, by controlled partial hydrolysis yielding hydroxyl soap structures.

By polycarboxylic acids are meant carboxylic acids obtained by reaction of unsaturated carboxylic acids with each other or with olefins. The oligomers thereof used are compounds consisting of 2 to 10 units, preferably 2 to 6 units.

As alcohol reactants with the carboxylic acid to make monomeric, oligomeric or polymeric carboxylic acid semi-esters thereof, linear or branched monohydric or polyhydric alcohols are used. It has proved to be advantageous if the carbon number is determined by the base fluid in order to ensure that the corresponding reaction products are soluble in that base fluid.

The alcohol moieties of the aluminum alcoholates used are lower straight and branched alcohols, for example those with 1 to 6 carbon atoms. The corresponding, formed alcohols are set free during reaction and are eliminated (removed). If the reaction is performed with anhydrides, straight-chain or branched alcohol moieties with up to 18 carbon atoms can be used as the alcohol moiety. In one embodiment of the invention, when carboxylic acid anhydrides are employed, only one group of —C(=O)—O—C(=O)—moieties react with the reactive aluminum compounds. Since these alcohol moieties add to the molecule, most of them remain in the reaction product. In a preferred embodiment of the invention, the hydrocarbon moieties of the anhydride are linked together as in tetra propenyl succinic acid (TPSA) anhydride.

Examples of component (a) are partial ester/aluminum compound adducts based on alkenyl succinic anhydrides, particularly n-hexenyl succinic anhydrides, diisobutenyl succinic anhydrides, tetrapropenyl succinic anhydrides, dodecenyl succinic anhydrides and polyisobutenyl succinic anhydrides. It will be appreciated that the groups termed "alkenyl" in these alkenyl succinic anhydrides are so called because they are made from unsaturated alkenyl compounds, but by this point the alkenyl groups technically are converted to alkyl groups. Also suitable are e.g. olefin addition products of itaconic, citraconic and mesaconic acid.

Further, copolymerisates of unsaturated carboxylic acids, e.g. of maleic, fumaric, acrylic or methacrylic acid are appropriate. Polyesters containing carboxyl groups which are based on saturated or aromatic dicarboxylic acids, such as adipic acid or phthalic acid, are also suitable.

Suitable aluminum alcoholates include, but are not necessarily limited to aluminum triisopropoxides, aluminum-tri-sec-butoxides or complex mixed alcohols and partial chelates, such as DOROX D 15™, DOROX D 300™, and DOROX D 310™ (commercial products of CONDEA Chemie GmbH, Hamburg).

It is preferable in one embodiment, to use those aluminum alcoholates where all the aluminum bonds carry alcoholate groups. Also suitable are aluminum alcoholates where one or two of the aluminum bonds carry hydroxyl groups.

Component (b) comprises hydraulic media, such as hydrocarbons, in general; conventional mineral oil selective raffinates; hydrocracking products; hydrogenates; poly-alpha-olefins (PAOs); synthetic esters; or silicone oils. The component (b) should be essentially non-conductive, should be capable of homogeneously dissolving the aluminum soaps, and preferably are non-polar or of low polarity.

The viscosities of the aforesaid fluids are selected depending on the intended use of the end product.

Examples of component (b) include, but are not necessarily limited to:

Spindle oil raffinate 6/20™ of DEA, Hamburg
Kinematic viscosity (40° C.): 4.2 $mm^2/s$
Density (15° C.): 840 kg/m3

Solvent raffinate SN 45™ of DEA, Hamburg
Kinematic viscosity (40° C.): 6.5 $mm^2/s$
Density (15° C.): 842 kg/m3

Hydrocracking product VHVI-light™ of DEA, Hamburg
Kinematic viscosity (40° C.): 30.4 $mm^2/s$
Density (15° C.): 854 kg/m3

Hitec 162™, PAO of Ethyl, St. Louis, Mo.
Kinematic viscosity (40° C.): 5.0 $mm^2/s$
Density (15° C.): 800 kg/m3

Priolube 3958™ of Unichema, Gouda
Kinematic viscosity (40° C.): 10.5 $mm^2/s$
Density (15° C.): 921 kg/m3

Component (c) comprises customary hydraulic additives for optimizing the hydraulic product characteristics, such as wear resistance, resistance to aging, friction characteristics, resistance to foaming, corrosion resistance and low-temperature characteristics.

Examples of component (c) include, but are not necessarily limited to:

Additin RC 3212™ of Rhein-Chemie, Mannheim 2-Ethylhexyl-Zn-dithiophosphate

Irganox L 107™ of Ciba-Geigy, Basel 2,6-di-tert-butylphenol

Viscoplex 1-300™ of Rohm, Darmstadt Polymethacrylate, 70% solution in neutral raffinate In a preferred embodiment of the process for producing electro-viscous fluids, the dilute olefin carboxylic acid semi-ester is placed into the vessel and blended with the aluminum carrier component in the absence of moisture. After the chemical reaction is complete, a sufficient amount of component (b) is added to adjust the viscosity to the rated value, and component (c), if any, is added as required.

In a voltage field of from about 500 V/mm field strength, the fluids thus prepared show a significant increase in viscosity as the field strength increases. Optimum response is reached between 3 and 8 kV/mm field strength, the aluminum content being preferably 0.1 to 0.5%. The initial viscosity of the electro-viscous fluid may be in the range of from 15 to 6,000 mPa.s at 40° C.

EXAMPLES

Embodiments of the Invention

In the Examples described following, Example 1 is a comparative example based on an olefin carboxylic acid not reacted with aluminum alcoholate. The acid proved to be ineffective.

Example 2 is another comparative example based on reaction with Li-alcoholate, not Al-alcoholate. The electro-rheological effect of the product is extremely weak and only detectable in a static test.

Examples 3 to 5 describe reaction products of the invention. The corresponding electro-rheological measurement results are shown in Tables I–III and FIGS. 1 and 2.

Example 1 (Comparative)

100 grams of an alkenyl (tetrapropenyl) succinic acid semi-ester having the following characteristics:

Density (15° C.) 985 kg/m$^3$

Kinematic viscosity (40° C.) 1,750 mm$^2$/s

Viscosity (100° C.) 31 mm$^2$/s

Flash point P.M. 175 °C.

Mineral oil content 37 wt. %

Acid number 144 mgKOH/g

Hydroxyl number 43 mgKOH/g were diluted with 100 g of a naphthenic mineral oil cut. Added to this mixtures were:

0.1% of a commercially available demulsifier and 0.1% of a commercially available defoamer.

The final mixture had a viscosity of 39 mm$^2$/s at 40° C. and an acid number of 72 mg KOH/g.

When testing the aforesaid mixture in a high-voltage rotary rheometer, no increase in yield stress was detectable up to a field strength of 8 KV/mm at a shear rate of D=1/1000.

Example 2 (Comparative)

100 grams of the final mixture as described in Comparative Example 1 were blended with a dispersion of 1 gram of lithium-sec-butylate in 5 ml of light oil by intensively stirring over a period of 30 minutes in the absence of moisture. The temperature was slowly increased to 80° C. over a period of 60 minutes where it was maintained for 90 minutes.

After cooling, the reaction product was diluted with 100 ml of petroleum ether and washed four times with 60 ml of $H_2O$. After filtration and vaporisation of the petroleum ether, 73 grams of a product having a viscosity of 160 mm$^2$/s at 40° C. and a lithium content of 0.11% were obtained.

When testing the aforesaid mixture in a high-voltage rotary rheometer, no increase in yield stress was detectable up to a field strength of 8 KV/mm at a shear rate of D=1/1000.

Example 3 (Inventive)

The procedure was the same as that described in Example 2, the difference being that the reaction was performed with a solution of 2.5 grams of aluminum-sec-butylate in 10 ml of light oil.

The end product had a a viscosity of 330 mm$^2$/s at 40° C. and an aluminum content of 0.24%.

The product showed a pronounced electro-viscous effect, as illustrated by the results presented in Table 1 and FIG. 1.

Example 4 (Inventive)

The procedure was the same as that described in Example 2, the difference being that the reaction was performed with a solution of 1.7 grams of aluminum-sec-butylate in 8 ml of light oil.

The end product had a a viscosity of 826 mm$^2$/s at 40° C. and an aluminum content of 0.17%.

The product showed a pronounced electro-viscous effect, as illustrated by the results presented in Table II.

Example 5 (Inventive)

The procedure was the same as that described in Example 2, the difference being that the reaction was performed with a solution of 1.2 grams of aluminum-sec-butylate in 5 ml of light oil.

The end product had a a viscosity of 800 mm$^2$/s at 40° C. and an aluminum content of 0.14%.

Figure 2:
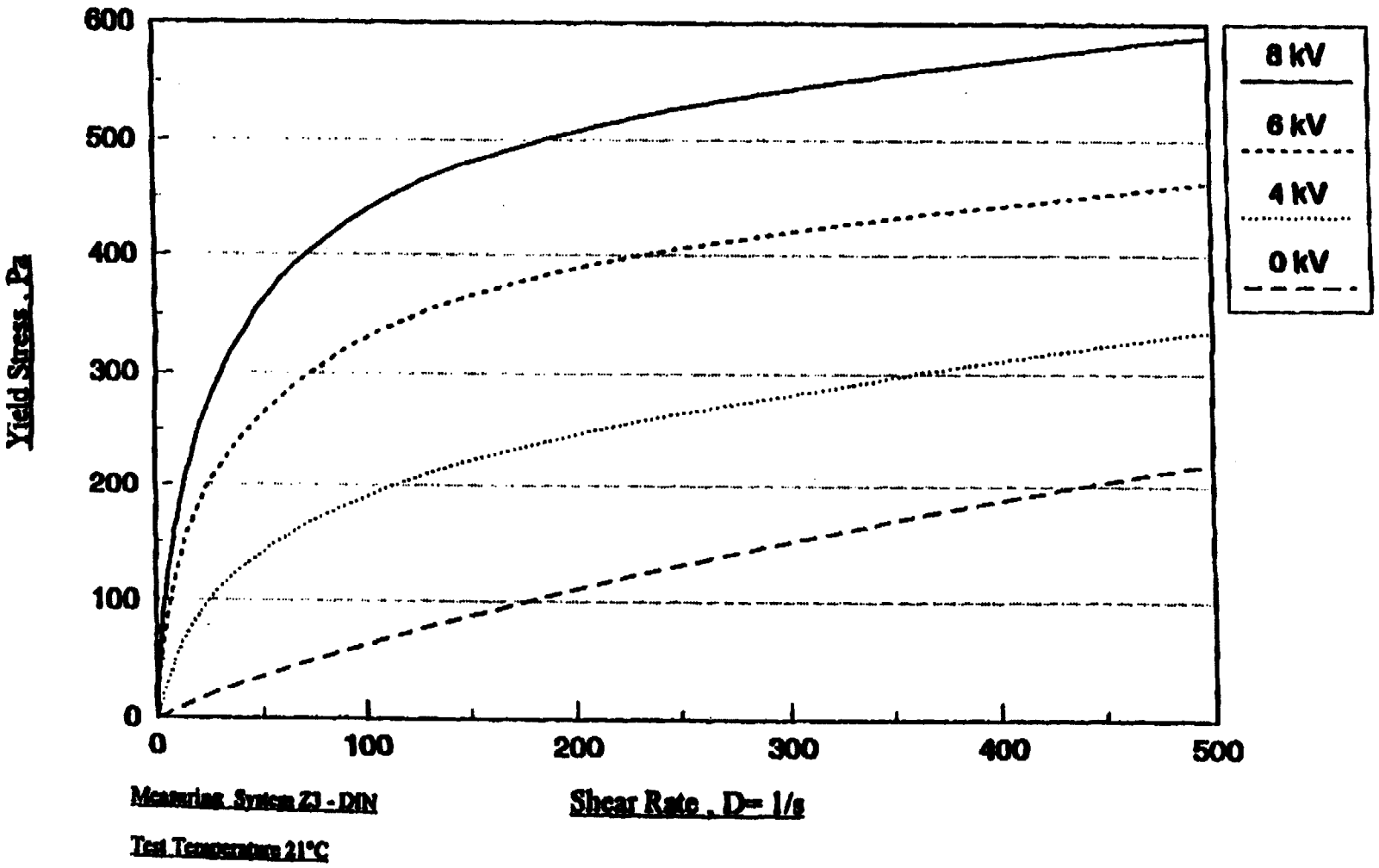
FIG. 2 is a chart of the yield stress as a function of shear rate for a homogeneous electro-viscous fluid of this invention.

The product showed a pronounced electro-viscous effect, as illustrated by the results presented in Table III and FIG. 2.

TABLE I

| | | Yield Stress/Shear Rate | | | | | | | | |
|---|---|---|---|---|---|---|---|---|---|---|
| | | Shear rate, D = 1/s | | | | | | | | |
| KV/mm | °C. | 1.3 | 5.1 | 10.3 | 25.8 | 51.6 | 103 | 194 | 297 | 503 |
| 0 | 21.3 | 1.2 | 10 | 19 | 40 | 70 | 120 | 190 | 250 | 370 |
| 1 | " | 4 | 16 | 25 | 50 | 80 | 133 | 204 | 269 | 380 |
| 2 | " | 8 | 27 | 43 | 74 | 110 | 166 | 240 | 302 | 410 |
| 3 | " | 12 | 44 | 68 | 110 | 160 | 220 | 294 | 355 | 458 |
| 4 | " | 18 | 64 | 98 | 148 | 220 | 288 | 364 | 428 | 525 |
| 5 | " | 18 | 67 | 135 | 197 | 285 | 366 | 442 | 507 | 602 |
| 6 | " | 48 | 118 | 177 | 250 | 362 | 450 | 525 | 590 | 685 |
| 7 | " | 72 | 157 | 228 | 315 | 440 | 535 | 605 | 675 | 765 |
| 8 | " | 95 | 192 | 267 | 375 | 523 | 610 | 680 | 750 | 835 |
| ERV - Factor | | 79 | 19 | 14 | 9.4 | 7.5 | 5.1 | 3.6 | 3.0 | 2.3 |
| ERV - Yield Stress | | 94 | 182 | 248 | 335 | 453 | 490 | 490 | 500 | 465 |

TABLE II

| | | Yield Stress (Pa) - Shear Rate | | | | |
|---|---|---|---|---|---|---|
| | | Shear Rate, D = 1/s | | | | |
| KV/mm | °C. | 50.3 | 103 | 200 | 300 | 500 |
| 0 | 21.3 | 130 | 219 | 369 | 488 | 682 |
| 1 | " | 145 | 231 | 380 | 497 | 688 |
| 2 | " | 180 | 267 | 413 | 526 | 715 |
| 3 | " | 235 | 325 | 469 | 578 | 760 |
| 4 | " | 310 | 402 | 542 | 646 | 821 |
| 5 | " | 390 | 500 | 627 | 729 | 895 |
| 6 | " | 480 | 590 | 726 | 821 | 976 |
| 7 | " | 590 | 695 | 820 | 917 | 1068 |
| 8 | " | 675 | 790 | 905 | 1010 | 1168 |
| ERV - Factor: | | 5.2 | 3.6 | 2.4 | 2.1 | 1.7 |
| ERV - Yield Stress, Pa: | | 545 | 571 | 536 | 522 | 486 |

TABLE III

Yield Stress (Pa) - Shear Rate

| KV/mm | °C. | Shear Rate, D = 1/s 50.3 | 103 | 200 | 300 | 500 |
|---|---|---|---|---|---|---|
| 0 | 21 | 33 | | 108 | | 213 |
| 1 | " | 40 | | 115 | | 221 |
| 2 | " | 60 | | 143 | | 249 |
| 3 | " | 91 | | 189 | | 292 |
| 4 | " | 137 | | 252 | | 352 |
| 5 | " | 190 | | 320 | | 416 |
| 6 | " | 261 | | 400 | | 510 |
| 7 | " | 340 | | 500 | | 590 |
| 8 | " | 410 | | 575 | | 660 |
| ERV - Factor: | | 12.4 | | 5.3 | | 3.1 |
| ERV - Yield Stress, Pa: | | 377 | | 467 | | 447 |

Examples 6 to 8 describe reaction products of the invention. The corresponding electro-rheological measurement results are shown in Tables IV.

Example 6 (Inventive)

Reaction of an Aluminum Oxo Alkyl 50 grams of the tetrapropenyl succinic acid semi-ester as described in Example 1 were dissolved in 150 ml of toluene, cooled to −30° C. and made less reactive. 33 ml of a 10% solution of methyl aluminum oxide (MAO—product of Witco company) were injected with a syringe. The temperature was gradually increased to room temperature whereby gas was formed. After evolution of gas was complete, the temperature was raised and maintained at 80° C. for 2 hours to complete reaction. The toluene was removed on a rotary evaporator and 50 ml of naphthenic white oil were added as hydraulic base oil. The product was then tested.

Example 7 (Inventive)

Reaction of an Aluminum Oxocarboxylate

A mixture comprised of 10 grams of the tetrapropenyl succinic acid semi-ester described in Example 1, 6 grams of aluminum-oxo-2-ethyl hexanoate (DOROX® D 490 of CONDEA Chemie), 15 grams of 2-ethylhexanoic acid and 130 grams of naphthenic white oil as hydraulic base oil was heated to 120° C. for 1 hour. After cooling, the product was tested.

Example 8 (Inventive)

Reaction of an Aluminum Oxide Hydrate

A mixture comprised of 10 grams of the tetrapropenyl succinic acid semi-ester described in Example 1, 2.5 grams of aluminum-oxide hydrate (Dispersal® of CONDEA Chemie), 15 grams of pelargonic acid and 130 grams of naphthenic white oil as hydraulic base oil was heated to 120° C. for 1 hour. Filtration by means of a press filter was performed at 80°–110° C. After cooling, the product was tested.

TABLE IV

ELECTRORHEOLOGICAL MEASUREMENTS

| | Tension U kV | Power I mA | Shear Rate 1/s | Yield Stress Pa | ERF Yield Stress Pa | ERF Factor |
|---|---|---|---|---|---|---|
| Example 6 | — | — | 600 | 103 | — | — |
| | 1.0 | 0.08 | 600 | 116 | 13 | 1.12 |
| | 2.0 | 0.12 | 600 | 142 | 39 | 1.37 |
| | 4.0 | 0.24 | 600 | 213 | 110 | 2.06 |
| | 6.0 | 0.32 | 600 | 341 | 236 | 3.31 |
| | 8.0 | 0.42 | 600 | 547 | 444 | 5.30 |
| Example 7 | — | — | 17.7 | 27 | — | — |
| | 1.0 | 0.00 | 17.7 | 36 | 9 | 1.33 |
| | 2.0 | 0.00 | 17.7 | 53 | 27 | 2.00 |
| | 3.0 | 0.01 | 17.7 | 82 | 56 | 3.09 |
| | 4.0 | 0.01 | 17.7 | 111 | 84 | 4.17 |
| Example 8 | — | — | 17.7 | 25 | — | — |
| | 1.0 | 0.00 | 17.7 | 34 | 9 | 1.36 |
| | 2.0 | 0.01 | 17.7 | 50 | 25 | 2.00 |
| | 3.0 | 0.01 | 17.7 | 74 | 49 | 2.96 |
| | 4.0 | 0.02 | 17.7 | 103 | 78 | 4.12 |

The data presented above for Examples 3 through 8 show that the homogeneous electro-viscous fluids of this invention would be particularly suited for use as hydraulic fluids when inserted into a machine, where pressure is applied to the fluid and the fluid is used to transfer the pressure through the machine. The viscosity of the fluid could be varied by applying and/or varying the electrical field around the fluid. For example, the electro-viscous fluids of this invention are particularly suited for use in the field of industrial and vehicle hydraulics, e.g. for machine and engine bearings or dampers, for positioning work-pieces, for levelling out, cushioning and damping vehicles, for hydrodynamic power transmission and automatic clutches. Not only do they have sufficiently high viscosities, as shown in the data, but they are entirely homogeneous and suffer no instability or separation problems. The inventive electro-viscous fluids are homogeneous in the absence of a dispersant necessary to keep the fluids homogeneous. The absence of a dispersant permits the fluids to be simpler and less subject to problems.

Hydraulic Applications

Example 9

Electrorheologically (ER) Adjustable Shock Absorber 75 g of product from Example 3 were diluted with a light refined mineral oil distillate to a volume of 150 ml total. A specially designed shock absorber fitted with a cylindrical ER-valve was charged with the above-noted fluid and then inserted into a hydraulic test rig.

Figure 3:
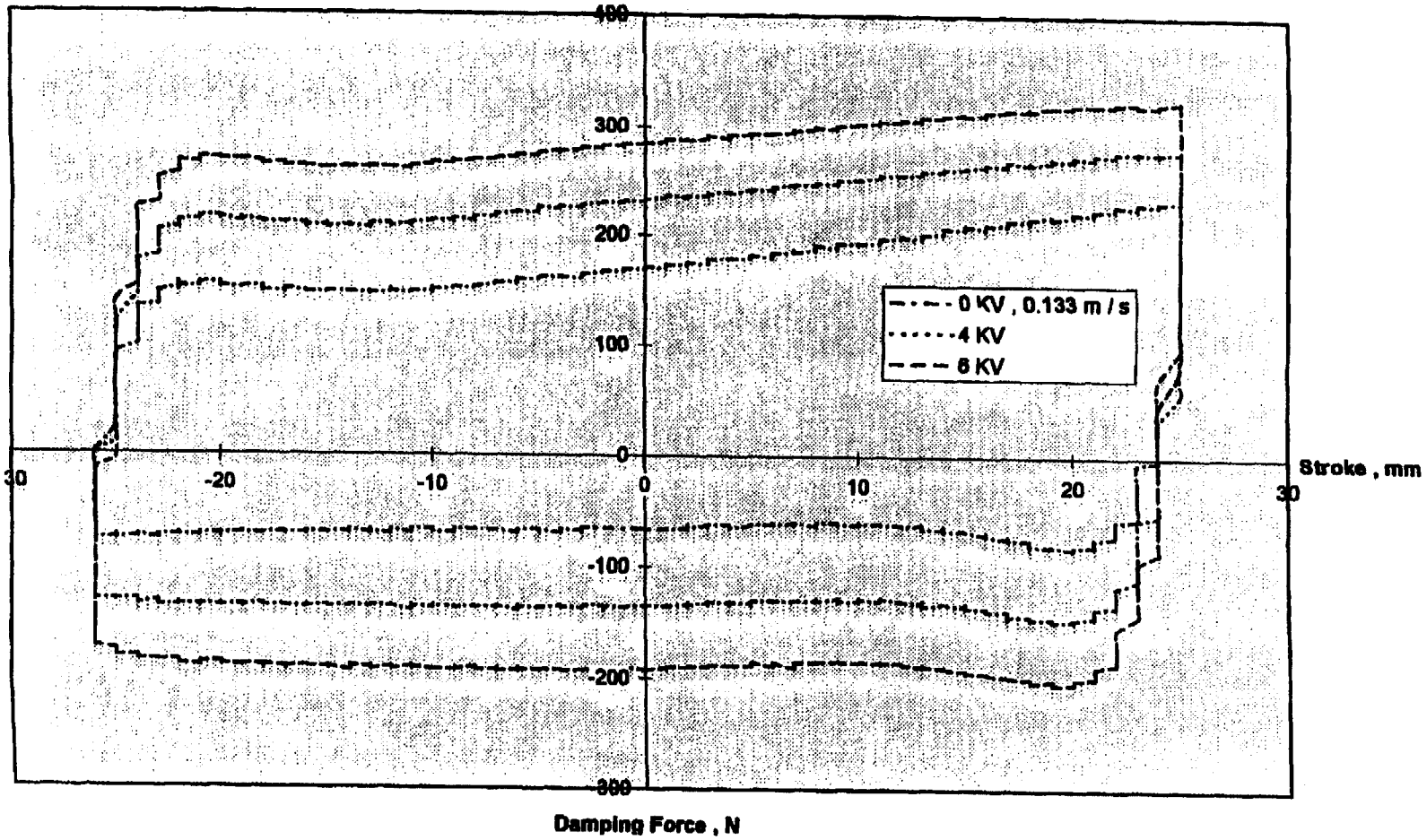
FIG. 3 is a graph of the controlled damping characteristics of Example 3 material at various applied electrical fields.

A test procedure applying different levels of high voltage demonstrated the fluid ability of controlled damping performance; the results of which are presented in FIG. 3.

Example 10

Electrorheologically (ER) Controlled Power Train 3000 g of product from Example 3 were diluted with 2000 g of a refined mineral oil cut to an ISO-grade-viscosity of 68. A closed hydraulic power line fitted with the standard hydraulic components and equipped with a specially designed hydraulic valve and pressure sensors was charged with the above fluid.

Figure 4:
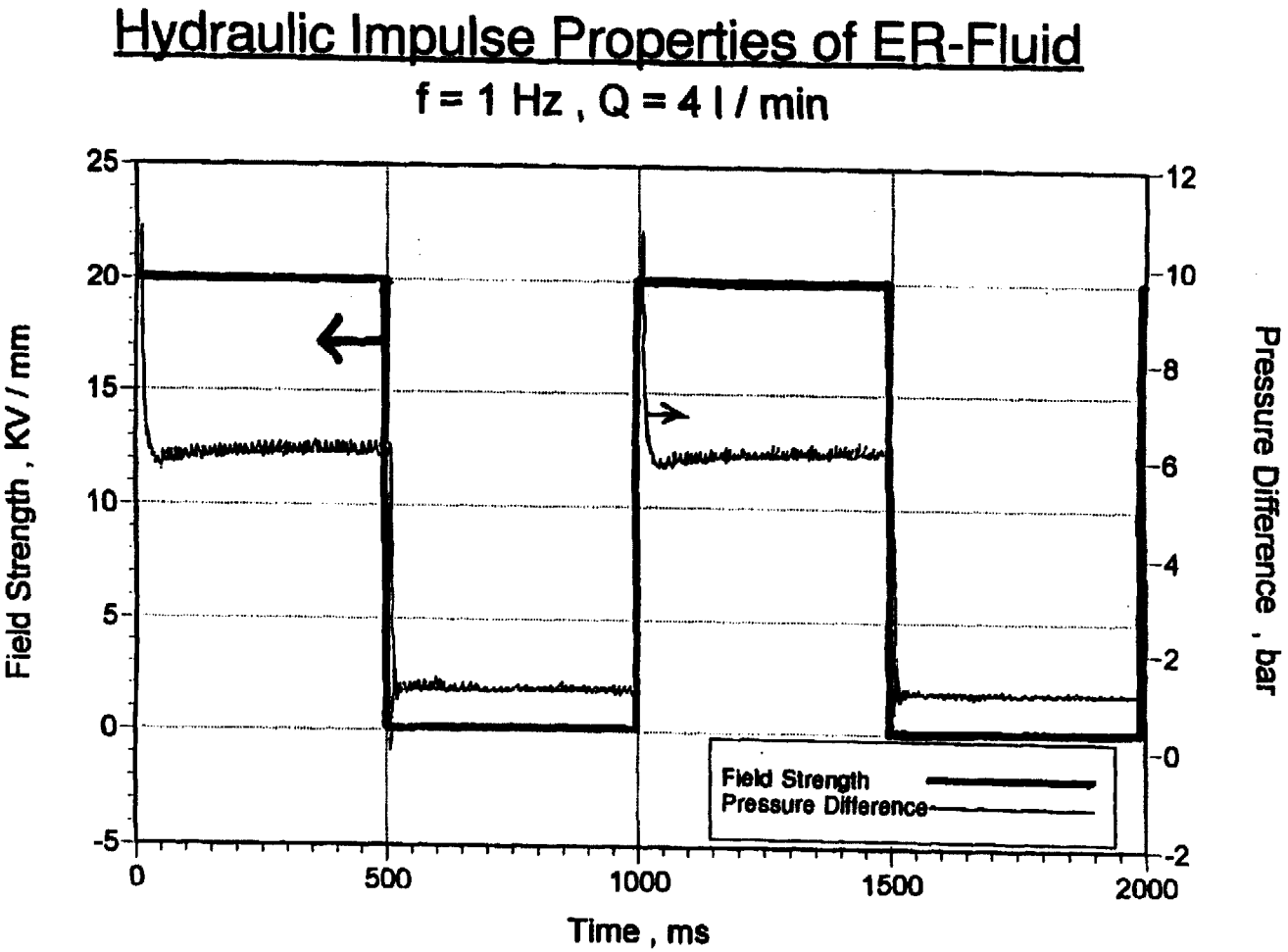
FIG. 4 is a graph of the fluid viscosity response time for an Example 3 material at square wave impulses from 1 KV/mm to 20 KV/mm.

To demonstrate the rapid response of fluid pressure to high voltage, the ER valve was charged with square wave impulses of 1 KV/mm up to 20 KV/-mm. The fluid viscosity response time is in the order of a few milliseconds, as shown in FIG. 4.

Example 11 (Comparative)

16.1 g 2-Ethylhexanoic acid were dissolved in 81.5 g light oil as described in comparative Example 2, and reacted with a solution of 2.5 aluminum secbutylate in 10 ml light oil as described in Example 3. After work-up with water as described in Example 2, a clear, colorless, non-flowable gel resulted, which could not be measured in a high voltage rotary rheometer.

All of the following additional compounds have shown significant ER effects:

Inventive Examples

Examples 12–15

Carboxylic acid semiester with various alcohol moieties

Acid component: Tetra propenyl succinic acid (TPSA)
Al component: Aluminum sec-butylate (ASB)
Solvent: Mineral oil

| Example | Alcohol moiety |
|---|---|
| 12 | 1,2-ethanediol |
| 13 | 1,2-neopentylglycol |
| 14 | 1,6-hexanediol |
| 15 | dipropyleneglycol |

Examples 16–18

Carboxylic acid derivatives

Al component: ASB
Solvent: Mineral oil

| Example | Carboxylic acid |
|---|---|
| 16 | TPSA |
| 17 | TPSA + TPSA-1,2-propanediol-semi ester |
| 18 | TPSA-anhydride |

Examples 19–20

Alkyl substituted dicarboxylic acids

Al component: ASB

| Example | Carboxylic acid |
|---|---|
| 19 | Ethylhexyl malonic acid in mineral oil |
| 20 | Diisobutenyl succinic acid in toluene |

Example 21

Polymeric carboxylic acid

Al component: ASB
Solvent: Mineral oil

| Example | Carboxylic acid |
|---|---|
| 21 | Ketchenlub 106-Derivate |

Ketchenlub 106 is an oligomeric copolymer of maleinic acid dibutyl ester and an α-olefin with an average molecular weight of 900 g/mol manufactured by Akzo. The acid groups were first selectively set free by treatment with KOH and thereafter partially esterified with 1,2-propanediol.

Many modifications may be made in the methods of using homogeneous electro-viscous fluids as hydraulic fluids described herein without departing from the spirit and scope of the invention which are defined only by the appended claims. For instance, it may be discovered that an aluminum soap made by reacting a particular carboxylic acid or anhydride or semi-ester or other derivative thereof with a particular reactive aluminum compound, or at a particular ratio, may give especially good results.

We claim:

1. A method of using a homogeneous electro-viscous fluid as a hydraulic fluid comprising:

A. inserting the homogeneous electro-viscous fluid into a machine, where the homogeneous electro-viscous fluid comprises:

aluminum soaps produced by a process comprising reacting i. at least one saturated or unsaturated monomeric, oligomeric or polymeric $C_3$ to $C_{32}$ carboxylic acid having at least two carboxylic groups, and/or an anhydride thereof or a semi-ester thereof, where the semi-ester has an alcohol moiety from straight or branched, monohydric or polyhydric $C_1$ to $C_{12}$ alcohols or oligomers thereof with ii. at least one aluminum compound reactive with carboxylic groups to form —C(=O)O—Al groups;

B. applying pressure to the homogeneous electro-viscous fluid; and

C. using the homogeneous electro-viscous fluid to transfer the pressure through the machine.

2. The method of claim 1 where the homogeneous electro-viscous fluid has a given viscosity, and where the method further comprises D. applying an electrical field to vary the viscosity of the fluid.

3. The method of claim 1 wherein the aluminum soaps of the homogeneous electro-viscous fluid are produced by reacting at least one saturated or unsaturated monomeric, oligomeric or polymeric $C_{3-C18}$ carboxylic acid having at least two carboxylic groups, an anhydride thereof or semi-ester thereof, with at least one reactive aluminum compound, as therein defined.

4. The method of claim 3 wherein the aluminum soaps of the homogeneous electro-viscous fluid are produced by reacting at least one alkenyl succinic acid or semi-ester thereof, where the alkenyl succinic acid or semi-ester thereof has 5 to 18 carbon atoms with at least one reactive aluminum compound, as therein defined.

5. The method of claim 1 wherein the aluminum soaps of the homogeneous electro-viscous fluid are produced by reacting:

i. at least one carboxylic acid, and/or an anhydride thereof or a semi-ester thereof, as therein defined with ii. at least one reactive aluminum compound, as therein defined; where at least one of the valences of the aluminum have reacted with the carboxylic acid, anhydride thereof or semi-ester thereof.

6. The method of claim 1 wherein the aluminum soaps of the homogeneous electro-viscous fluid are produced by reacting:

i. at least one carboxylic acid, and/or an anhydride thereof or a semi-ester thereof, as therein defined with ii. at least one reactive aluminum compound, as therein defined; where at least one free OH group of the carboxylic acid, anhydride thereof or semi-ester thereof have reacted with the reactive aluminum compound.

7. The method of claim 1 wherein the semi-esters of the carboxylic acid for the aluminum soaps of the homogeneous electro-viscous fluid, the alcohol moiety thereof is selected from the group consisting of di-, tri- and tetrahydric alcohols with 1 to 6 carbon atoms and the oligomers thereof.

8. The method of claim 1 where the aluminum compound is selected from the group consisting of:

a. aluminum alcoholate comprising an alcohol moiety thereof comprising one or more aliphatic straight or branched, mono- or polyhydric $C_1$ to $C_{18}$ alcohols;

b. aluminum oxoalcoholate comprising an alcohol moiety thereof comprising one or more aliphatic straight or branched, $C_1$ to $C_6$ alcohols;

c. aluminum alkyls where the alkyl moieties are linear or branched $C_1$ to $C_6$ alkyl;

d. aluminum oxo alkyls where the alkyl moieties are linear or branched $C_1$ to $C_6$ alkyl;

e. aluminum hydroxycarboxylates where the carboxylic acid moieties are obtained from linear or branched aliphatic or unsaturated $C_2$ or $C_{30}$ carboxylic acids;

f. aluminum oxocarboxylates where the carboxylic acid moieties are obtained from linear or branched aliphatic or unsaturated $C_2$ or $C_{30}$ carboxylic acids;

g. aluminum alkoxycarboxylates where the alcohol moieties of the aluminum alkoxycarboxylates are linear or branched $C_1$ to $C_6$ alcohols and where the carboxylic acid moieties of the aluminum alkoxycarboxylates are linear or branched aliphatic or unsaturated $C_2$ to $C_{30}$ carboxylic acids;

h. aluminum oxides and aluminum oxide hydrates of the general formula $Al_2O_3.nH_2O$, where n ranges from 0 to 6;

i. aluminum metal;

j. aluminum hydride;

k. aluminum-tris-acetylacetone; and l. aluminum monocarboxylate.

9. The method of claim 1 where the homogeneous electro-viscous fluid additionally comprises aluminum soaps made by reacting the said aluminum compound with at least one saturated or unsaturated monomeric, oligomeric or polymeric $C_3$ to $C_{32}$ carboxylic acid having only one carboxylic group, and/or an anhydride thereof or a semi-ester thereof, where the alcohol moieties thereof are defined as in claim 1.

10. The method of claim 1 where the homogeneous electro-viscous fluid comprises at least one aluminum atom bonded to at least two carboxylic groups.

11. The method of claim 1 where the homogeneous electro-viscous fluid further comprises 1 to 20 wt. % of the said aluminum soap;

60 to 95 wt. % of a conventional hydraulic base fluid; and 0 to 5 wt. % of soluble hydraulic additives.

12. The method of claim 1 where the homogeneous electro-viscous fluid further comprises 1 to 8 wt. % of the said aluminum soap;

65 to 90 wt. % of a conventional hydraulic base fluid; and 0.1 to 2 wt. % of soluble hydraulic additives.

13. A method of using a homogeneous electro-viscous fluid as a hydraulic fluid comprising the steps of:

A. inserting the homogeneous electro-viscous fluid into a machine, where the homogeneous electro-viscous fluid comprises:

(a) 0.5 to 50 wt. % of an aluminum soap produced by a process comprising reacting i. at least one saturated or unsaturated monomeric, oligomeric or polymeric $C_3$ to $C_{32}$ carboxylic acid having at least two carboxylic groups, and/or an anhydride thereof or a semi-ester thereof, where the semi-ester has an alcohol moiety from straight or branched, monohydric or polyhydric $C_1$ to $C_{12}$ alcohols or oligomers thereof with ii. at least one reactive aluminum compound selected from the group consisting of:

a. aluminum alcoholate comprising an alcohol moiety thereof comprising one or more aliphatic straight or branched, mono- or polyhydric $C_1$ to $C_{18}$ alcohols;

b. aluminum oxoalcoholate comprising an alcohol moiety thereof comprising one or more aliphatic straight or branched, $C_1$ to $C_6$ alcohols;

c. aluminum alkyls where the alkyl moieties are linear or branched $C_1$ to $C_6$ alkyl;

d. aluminum oxo alkyls where the alkyl moieties are linear or branched $C_1$ to $C_6$ alkyl;

e. aluminum hydroxycarboxylates where the carboxylic acid moieties are obtained from linear or branched aliphatic or unsaturated $C_2$ or $C_{30}$ carboxylic acids;

f. aluminum oxocarboxylates where the carboxylic acid moieties are obtained from linear or branched aliphatic or unsaturated $C_2$ or $C_{30}$ carboxylic acids;

g. aluminum alkoxycarboxylates where the alcohol moieties of the aluminum alkoxycarboxylates are linear or branched $C_1$ to $C_6$ alcohols and where the carboxylic acid moieties of the aluminum alkoxycarboxylates are linear or branched aliphatic or unsaturated $C_2$ to $C_{30}$ carboxylic acids;

h. aluminum oxides and aluminum oxide hydrates of the general formula $Al_2O_3.nH_2O$, where n ranges from 0 to 6;

i. aluminum metal;

j. aluminum hydride;

k. aluminum-tris-acetylacetone; and l. aluminum monocarboxylate; the aluminum soap being in homogeneous solution with (b) 50 to 98 wt. % of a conventional hydraulic base fluid; and (c) 0 to 10 wt. % of a soluble hydraulic oil additive; where each wt. % refers to the total homogeneous electro-viscous fluid;

B. applying pressure to the homogeneous electro-viscous fluid; and

C. using the homogeneous electro-viscous fluid to transfer the pressure through the machine.

14. The method of claim 1 where the homogeneous electro-viscous fluid comprises at least one carboxylic acid wherein at least two of the carboxylic groups of said carboxylic acid are bonded to different aluminum atoms.

* * * * *